US005921111A

United States Patent [19]

Maier et al.

[11] Patent Number: 5,921,111

[45] Date of Patent: Jul. 13, 1999

[54] WARP KNITTING MACHINE WITH TWO DIFFERENT KNITTING AREAS

[75] Inventors: Stefan Maier; Erich Thumser, both of Selbitz; Rudi Wirth, Schwarzenbach/W., all of Germany

[73] Assignee: LIBA Maschinenfabrik GmbH, Naila, Germany

[21] Appl. No.: 08/832,208

[22] Filed: Apr. 8, 1997

[30] Foreign Application Priority Data

Apr. 19, 1996 [DE] Germany ..... 196 15 671

[51] Int. Cl.[6] ..... D04B 23/02

[52] U.S. Cl. ..... 66/87

[58] Field of Search ..... 66/87, 207

[56] References Cited

U.S. PATENT DOCUMENTS

| | | | |
|---|---|---|---|
| 3,221,520 | 12/1965 | Bassist | 66/87 |
| 3,665,733 | 5/1972 | Jackson . | |
| 3,952,549 | 4/1976 | Kohl | 66/207 |
| 4,083,506 | 4/1978 | Mander et al. | 242/25 R |
| 4,302,953 | 12/1981 | Wilkens . | |
| 4,736,602 | 4/1988 | Denzler et al. | 66/210 |

FOREIGN PATENT DOCUMENTS

| | | |
|---|---|---|
| 257 615 | 3/1913 | Germany . |
| 454 467 | 1/1928 | Germany . |

*Primary Examiner*—Andy Falik
*Attorney, Agent, or Firm*—Frohwitter

[57] ABSTRACT

There is a description of a device for the production of warp knitted fabrics which are being produced on one knitting machine having two separate and independent knitting areas. Each of the independent knitting area has at least one guide bar and at least one needle bar. The knitting areas are placed back-to-back so that the directions of the respective material pull-offs are outwardly from the machine away from each other. The needle bars and the guide bars are supported by a common machine frame which has been provided with a common drive serving both knitting areas. Thereby, a high productivity is obtained having a minimum of space and energy requirements and a low initial investment cost.

8 Claims, 5 Drawing Sheets

WARP KNITTING MACHINE WITH TWO DIFFERENT KNITTING AREAS

The invention relates to a device for the production of a warp knitted product.

From the state of the art technology it is known that warp knitting machines have been constructed with double needle beds for the production, for example, of a special knitted product, for example, having two backings between which threads are placed in a to-and-fro manner. Such warp knitting machines include a knitting location having two needle bars and they serve for the production of so-called spaced knits. In each case, however, there is involved only a single knitted product which runs between adjacent needle bars, that is, it is being pulled down.

There is a description in DE-PS 454 467 of a warp knitting machine for the production of a double knitted product which includes two knitting locations. both knitting locations, however, are driven by only one drive shaft.

There is a description in DE-PS 16 35 846 of a warp knitting machine having two needle bars which in turn are driven by two levers which in turn are controlled by eccentric discs. The eccentric disc itself is driven by a main shaft in the form of a crank shaft. The levers thereby are connected by way of swings respectively, pushers with so-called bar support levers and in such a manner that the knitting needle bars undergo the alternating movements necessary for the knitting process itself.

Also in DE-AS 28 51 995 there is a description of a warp knitting machine having two needle bars including several guide bars which are being swung through the rows of knitting needles according to predetermined movements dictated by the final knitted product to be obtained. In this case, the drive of the needle bars is derived for each from a single drive, respectively a crank shaft. From the drive shaft a corresponding pusher is connected to a swing lever having been fastened to each of the needle bars so that the needle bars are movable alternatingly relative to each other. The drive is undertaken in such a manner so that the crank shaft for the drive of the one needle bar has the same number of rotations as the main shaft which also drives the second needle bar by way of an eccentric and corresponding pusher and lever connections. The produced knitted product again is led downwardly between the needle bars of the machine and then guided to a wind-up device.

Also in DE-AS 12 84 023, a warp knitting machine is being described having two needle formations. The guide bars, which carry the guide needles, with the guide needles being guided through the needle spaces of the knitting needle formations while the knitting is in progress. In this machine, the guide bars are subdivided into two part suspension gears which are driven in the same rotational sense and are further supported on two suspension shafts lying parallel to each other and symmetrically to the knitting needle formations. Because of this subdivision, a more even movement of the knitting needles can be obtained without having to rely on the knitting needles having to remain in a certain position to assure an effective knitting process. The knitting needle bars are arranged in pairs relative to each other so that the produced knitted product can be guided downwardly between the needle bars in the machine and then guided to a wind-up device.

The in the state of the art known warp knitting machines having two needle bars merely produce only a single knitted web of fabric. However, it is throughout possible that a special knitted product having two backs, for example, can be separated after having been pulled down from the knitting area in that the connecting threads running to-and-fro between the two backs are separated as by cutting. However to accomplish this, a further working step must be provided in connection with additional cutting and wind-up mechanisms. This mandates the installation of cutting mechanisms in the warp knitting machine or additional machines which are placed adjacent the specific knitting machine or additional transport steps when the finally wound-up knitted web has to be transported to a remote location to a separation device.

It is therefore an object of the invention at hand to create a device for the production of warp knitted products by means of which a higher production is obtained using less space, less energy and less initial investment. This is accomplished by producing at least two warp knitted webs but separate from each other on the same machine having knitting areas on two sides which are easily accessible for service.

According to one aspect of the invention, there is provided a device for the production of a warp knitted fabrics on a warp knitting machine having at least two independent knitting areas wherein each of said knitting areas includes at least one needle bar and at least one guide bar for the production of each a fabric web and wherein said knitting areas are arranged back-to-back so that the direction of respective web pull-offs are directed outwardly away from said knitting areas and wherein said needle bars and said guide bars of both knitting areas are supported in a common machine frame, wherein the machine frame has been provided with a common main shaft which drives both knitting areas over compound drives.

According to the invention, the device for the production of warp knitted products exhibits at least two knitting areas which are independent from each other including for each at least one guide bar and at least one needle bar for the production of one fabric web each. The knitting areas are arranged back to back and web pull downs are directed in opposite directions away from the knitting areas. The needle bars and the guide bars are supported by a common machine frame having only one drive operating on both knitting areas. Therefore, the common machine frame serves the purpose of receiving the drive for the main shaft so that the corresponding subcomponents for the production of the warp knitted product are driveable from out of the machine frame by way of corresponding drives from the driven main shaft.

According to the invention, both the needle bars and the guide bars of the knitting areas can be driven from a common main shaft, whereby the shaft drives both knitting areas by way of compound drives. Thereby, the number of the necessary subcomponents to drive the knitting bars in each knitting area is advantageously reduced which at the same time reduces the space requirements for the machine while also reducing the demand for energy.

Because of the division to at least two separated knitting areas, it is possible by means of the inventive device to simultaneously produce two knitted fabric webs independent of each other. A substantial advantage can be realized in such an arrangement, that is, besides the increased production when creating a warp knitted product, there is also a decreased demand on energy as well as a lessened demand on space for the machine.

The device according to the invention, which could also be characterized as a double warp knitting machine when compared to a single machine, exhibits a substantially higher flexibility relative to the art of warp knitted webs, the use of materials, the patterns to be obtained etc. which can be produced with such a machine. This equally is applicable to super wide warp knitting machines having, by way example, a double working width on which two warp knitted webs can be produced, however, these two webs are completely identical.

As a matter of principal, it is possible that the knitting bars of each knitting area can be driven by a separate main shaft which are commonly driven by the drive arranged in or on the common machine frame. On one hand one obtains that the movements of the knitting bars of each individual knitting area can easily be matched with the predetermined mandates because of the corresponding and interposed drives. On the other hand, this matching also results in that differing knitted products can be created in each of the knitting areas.

In order to avoid that the whole machine has to be shut down when certain operational breakdowns appear, such as a thread break, for example, whereby the advantage of the inventive machine with regard to a higher production would be minimized, a coupling has been provided between the drive and the respective main shaft. Thereby, it is possible to shut down one knitting area over the corresponding coupling while the other knitting area or necessarily other knitting areas continue to produce. Because of this, the number of the subcomponents, because of the couplings, will somewhat increase, the flexibility of the use of the inventive device will further increase also.

According to a preferred embodiment, the bars of each of the knitting areas are driven by coupling drives controlled by the main shaft. Under normal conditions, for each of the knitting areas, that is, for the left knitting area and the right knitting area (see FIG. 1), left as well as right drives have been provided so that the main shaft, which has been fashioned as a crank shaft, has been provided with several off-set cranks. That means, that if for each progressive movement of the bars an individual drive has been provided, a certain type of drive for each would also be required. Under certain circumstances this could create problems with regard to fitting the same within the common machine frame, so that the machine with regard to its working width as well as with regard to its length would have to be enlarged. The coupling drives, however, have the advantage that they also can be manufactured as compound drives. Thereby it is possible, for example, to completely install at least one connection drive for each of the two movements, respectively, progressive movements, for example, for the guide bar and the needle bar as well as the pushers and the plate bar. Thereby, a substantially simplified crank shaft can be installed needing only half of the number of the cranks.

According to a preferred embodiment of the invention, to each of the knitting areas is assigned a group of warp beams and/or spool frame for each material pull-off.

In the case, that as a thread delivery system, warp beams have been provided, it is preferred that each of the two warp beams from both groups of warp beams, which are installed in a warp beam frame of the warp knitting machine, are driven by a common warp beam drive. A common warp beam drive for each of the commonly assigned warp beams for each of the knitting areas further simplifies the overall machine construction. This, most of all, makes sense when on the inventive warp knitting machine knitted fabric webs are to be produced having the same quality, the same material and the same pattern.

When using such an arrangement of warp beams in which each group of warp beams, they should be located sideways from a symmetry plane which extends through the knitting areas. Under "plane of symmetry" in this regard should not be understood that the back-to-back arrangement allows the creation of a complete mirror image device but rather it is understood that under "symmetry plane" a mental bisecting plane is present through the knitting area.

In a still further embodiment of the invention it is preferred that the shifting movement of the guide bars of both knitting areas is controlled by a common shifting drive. It is still understood that the left as well as the right knitting area each can be provided with a different pattern disc.

A still further and especially preferred embodiment is present when the inventive device is being used to produce, in each of the knitting areas, knitted products that are different from each other. However, in this case it is not possible to provide a common drive for the knitting elements and their corresponding warp beams. The inventive device still exhibits a high productivity and capacity, respectively, when the individual knitting areas are arranged and operating independently from each other.

In a further preferred embodiment it is possible that in one knitting area, for example, two bars have been provided while the other one has been constructed with three bars. It is also possible that both knitting areas have the same number of guide bars. The number of guide bars provided in each of the knitting areas can be same, that is, even-numbered as well as odd-numbered or the number can be different, again even-numbered as well as odd-numbered.

In a still further embodiment of the invention it is preferred that a weft insertion system be arranged between the knitting areas. Such a weft insertion system can be fashioned after what is known in the weaving art, that is, compressed air or air-jet systems or the use of projectiles. Depending on the size of the weft insertion systems, they can be arranged each in the inner area of the knitting area where sides face each other.

Preferably the inventive device is provided with pol bars.

According to a further embodiment of the invention, a device having been outfitted with two needle bars for the production of a warp knitted product can include a jacquard-device, that is, such a double warp knitting machine can, without a doubt, be constructed with a jacquard control.

Further advantages, characteristics and application possibilities of the invention at hand will now be described as an embodiment with reference to the drawings and the following description.

DETAILED DESCRIPTION OF THE DRAWINGS

Figure 1:
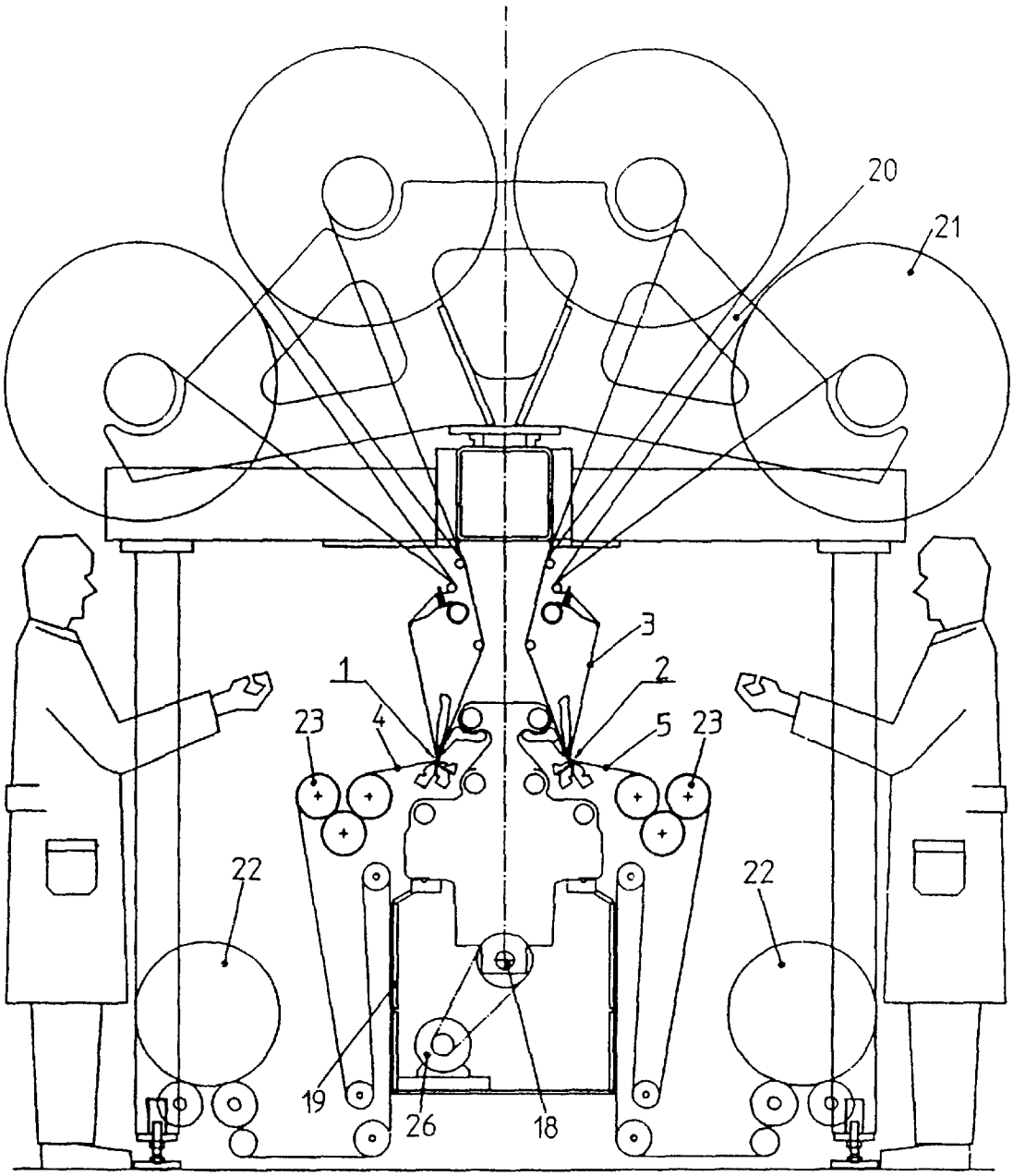
FIG. 1 is a side view of the basic construction of the inventive device including a main shaft.

FIG. 1 shows, schematically, a side view of the inventive device for the production of warp knitted products including two independent knitting areas. To obtain a basic size comparison, an operator is shown schematically. On a warp beam frame 28 two groups each of two warp beams 21 are supported. From the warp beams 21 the threads 3 run over corresponding guide or deviation devices to the two independent from each other knitting areas 1 and 2. The knitting areas 1, 2 each include independent guide bars 6 and 7, respectively, as well as the corresponding knitting element bars 10, 11, 12, 13, 14, and 15. (see FIG. 2). The independent knitting areas are arranged on a common machine frame 19 in which a drive 26 is located for the main shaft 18. From the main shaft 18, by way of the corresponding coupling drives, the corresponding knitting elements are driven to effect the required movements for the production of the knitted fabric.

From the knitting areas 1, 2, whose knitting elements with regard to the machine longitudinal axis are opposed to each other in a mirror image, the produced fabric webs 4, 5, respectively, are pulled away outwardly over corresponding material pull-off rolls 23 from the knitting areas 1 and 2 and are guided by deviation and guiding mechanisms to each one of the wind-up rollers 22, Because of the fact that two independent knitting areas 1, 2 are located within one device, a machine being quite compact can be realized and furthermore, because of deriving a drive from a common main shaft 18, a saving of energy is realized when compared to a single warp knitting machine producing a single fabric web alone at any one time. Also a greater flexibility is realized because in the independent knitting areas, different fabric webs can produced independent of each other.

As shown in FIG. 1, according to the inventive device, the main shaft 18 is located essentially in the middle of the machine. The advantage of a single main shaft consists in that the drive for the independent knitting areas 1, 2 can be simplified in its construction which leads to a reduction of the individual parts or groups of parts to be installed. If, in the example shown in FIG. 1, in both knitting areas the same knitted product is produced, there is a saving in their drive system for the warp beams because associated warp beams are driven from a single drive. Basically the same is true for the drive of the material pull-off systems.

In order to obtain a favorable equalization of the moving masses, the knitting elements of knitting areas 1, 2 are driven asynchronously relative to each other, that is, they execute contrary movements relative to each other. These contrary movements are derived from the main shaft 18 which induces corresponding movements in the corresponding knitting elements. In order to obtain these contrary movements, the main shaft 18 has been provided with corresponding set-off cranks for the left as well as the right sides, that is, for the left 1 and for the right 2 knitting areas.

Figure 2:
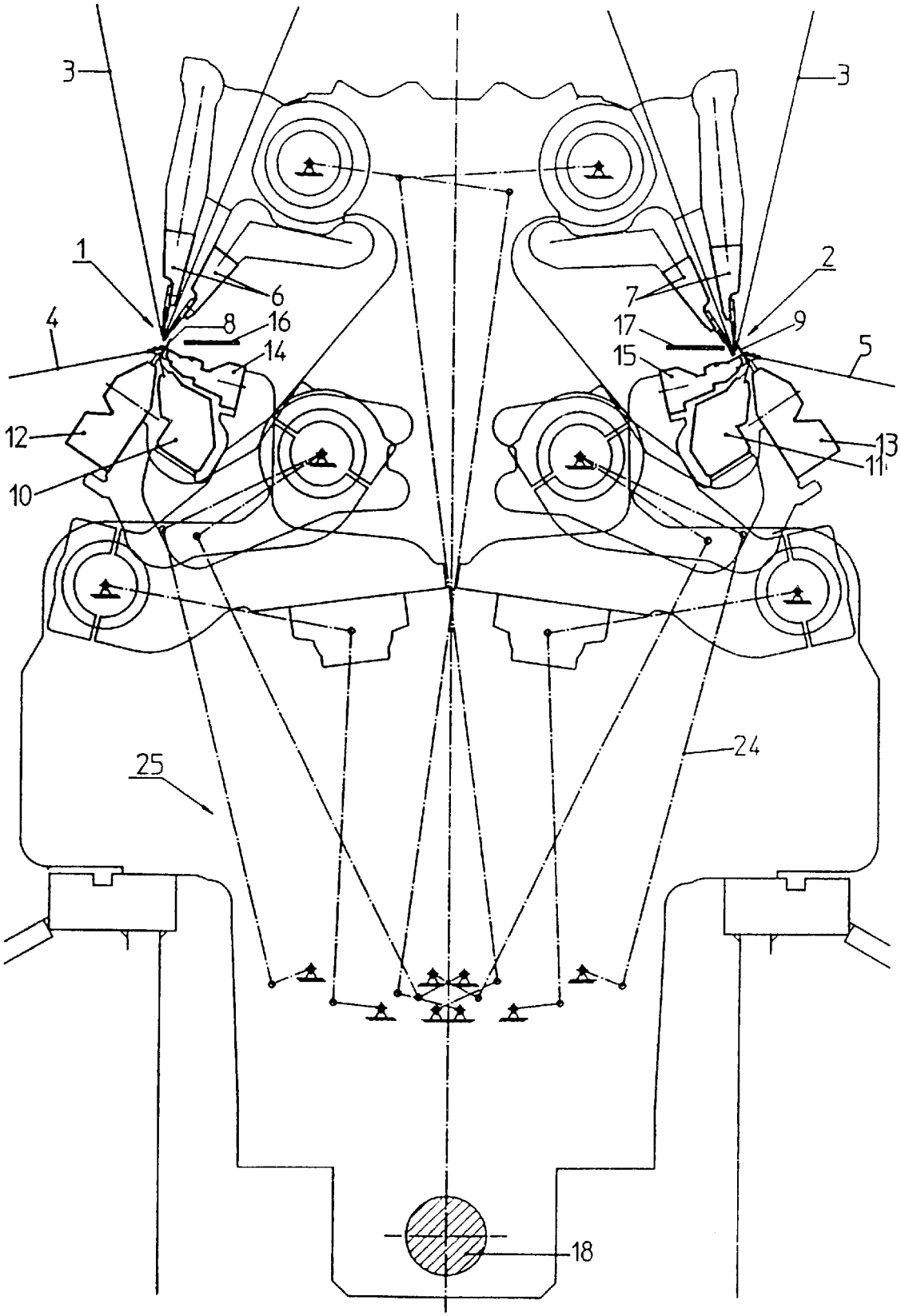
FIG. 2 is a sectional view of the knitting areas including the basic drive of the knitting elements of a device according to FIG. 1.

FIG. 2 shows an enlarged sectional view of the basic illustration of the device in FIG. 1. In this illustration, the independent knitting areas 1 and 2 are shown in an enlarged view. The knitting areas 1, 2 are supplied with threads 3 by way of guide needles fastened to guide bars 6, 7. Completely separated from each other, a complete set of knitting bars 10, 12, 14 is located on the left side of the machine which corresponds to the knitting area 1 and another complete set 11, 13, 15 is located on the right side of the machine which corresponds to the knitting area 2. In each of the knitting areas 1, 2 are located needle bars 12, 13 carrying the knitting needles 8, 9, pusher bars 10, 11 and guide bars 14 and 15 which are driven by the main shaft 18 by way of a corresponding coupling drive 25 through respective coupling members 24 which induce the respective knitting elements to undergo their respective movements. In order to simplify the illustration, the coupling members 24 have only been shown schematically in dot-dash lines including the respective points of joints.

In between the individual knitting areas 1, 2, a weft insertion system 16, 17 can be placed. The weft insertion system can thereby be fashioned as is known in weaving looms such as compressed air or air-jet systems or systems using projectiles.

A weft insertion system (16, 17) can be arranged to be located between each of the knitting areas. The weft insertion can be fashioned according to what is known in weaving machines, such as compressed air or air-jet or by the use of projectiles.

From the independently operating knitting areas 1, 2, the finished material webs 4, 5 are separately pulled down over the material pull-down rollers 23 and are then guided to corresponding wind-up rollers 22. When, as is illustrated in the embodiments of FIGS. 1 an 2, the drive 26 of the inventive device is realized from a single main shaft 18, then the overall construction of the inventive device can further be simplified by arranging a common shifting mechanism 40 for both guide bar groups of each of the knitting areas 1, 2. (see FIG. 5).

Basically it is also possible to provide two shafts (not shown) which are driven by way of one main drive which in turn is driven by the drive 26. When using two shafts, then the main shaft 18 is responsible for the creation of the required movements of the corresponding knitting elements, respectively, the generation of the movements of the corresponding knitting elements. That means, that the main shaft 18 is assigned to the knitting elements of the knitting areas 1, 2. In order to realize a high flexibility with a device having been provided with two shafts for the production of a warp knitted product according to the invention, couplings 28, respectively, 29 have been provided between each of the shafts and the transmission path for generating the respective movements of the knitting elements in knitting area 1 as well as 2. Thereby, it is possible to shut down one half of the device, that is, one knitting area while the other one continues to operate.

Figure 3:
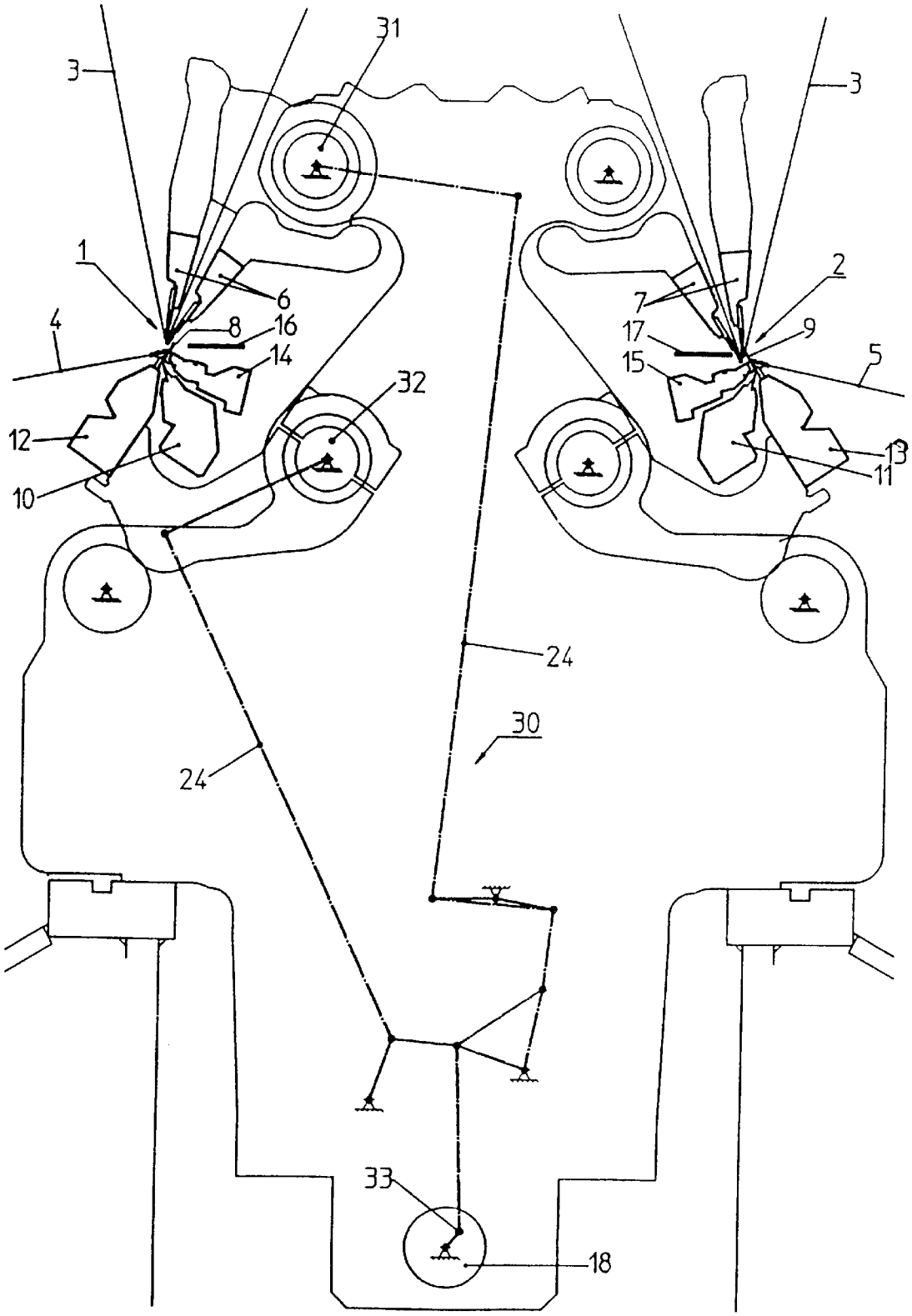
FIG. 3 is a sectional view of the knitting areas according to FIG. 2 but having a coupling drive formed as a compoud drive for the guide bar and the needle bar.

FIG. 3 shows a sectional view of the basic arrangement of the knitting areas 1, 2 according to the invention having only one main shaft 18 driven by drive 26, as shown in FIG. 2. While FIG. 2 shows an embodiment wherein coupling members 24 are illustrated as leading to the knitting elements which serve to realize the required movements, while the knitting is in progress, whereby for each knitting element movement a separate drive has to be provided and thereby a separate crank on the main shaft 18, the embodiment in FIG. 3 shows an example of illustrating a combined coupling drive, that is, a so-called compound drive. In such a compound drive, by means of combined drives by way a crank trunnion of the main shaft 18, the shaft 31 for the guide bars as well as the shaft 32 for the needle bars are driven. Because of combining the drive for the guide bar shaft 31 with the drive for the needle bar shaft, the resulting compound drive is being designated as LENA-compound drive 30. The basic arrangement of the knitting elements of the knitting area 1 as well as 2 including the delivery of the threads and the pull-down of the fabric webs 4, 5 corresponds to what is shown in FIG. 2 and, therefore, a detailed description will not be repeated here. An advantage of such a compound drive consists in that the structure of the main shaft 18 can be simplified, because the number of cranks otherwise necessary for the respective movements of the knitting elements can be reduced. A corresponding compound drive is also contemplated for the guide bars and the needle bars of knitting area 2 but for reasons of simplicity has not been shown.

Figure 4:
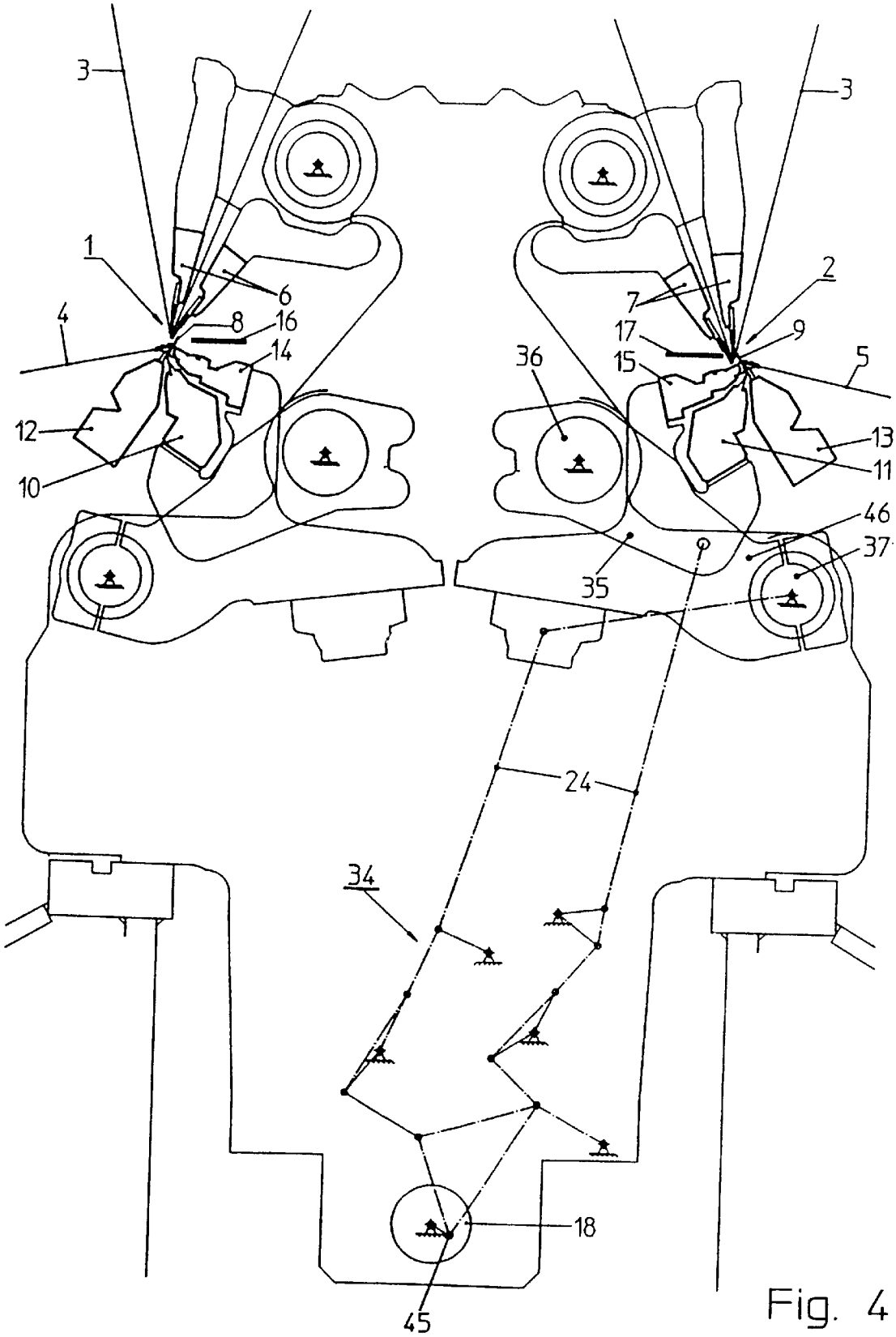
FIG. 4 is a sectional view of the knitting areas according to FIG. 3 but having a coupling drive formed as a compound drive for the plate bar and the pusher bar

FIG. 4 is a sectional view of the knitting areas 1, 2 according to FIG. 3, and illustrated therein, however, with the difference that in this Fig. the basic arrangement has been provided with a coupling drive having been formed as a compound drive 34 for the common drive for the plate bar 15 and the closure bar 11. The coupling members 24 are formed in such a manner so that from a common crank trunnion 45, the required phase shifting is transferred to the plate bar 15 and the closure bar 11. The coupling members 24 for the closure bar 11 are thereby linked to the lever element 35 of the closure bar 11 because the closure bar 11 is pivotal around shaft 36. The coupling members 24 for the drive of shaft 37 for the plate bar are thereby linked to the shaft 37 and will shift this shaft 37 into the required swing movement, whereby a lever element 46 for the plate bar is fixed to shaft 37 by way of a tension device. The remaining arrangement of the knitting elements corresponds again to FIG. 2 and has been described above. The combination of the drive for the plate bar and the drive for the closure bar is also designated as a PLASHI-compound drive. The advantage of such a compound drive consists in that the number of the cranks on the main shaft 18, to obtain the respective movements of the knitting elements, can be reduced.

Figure 5:
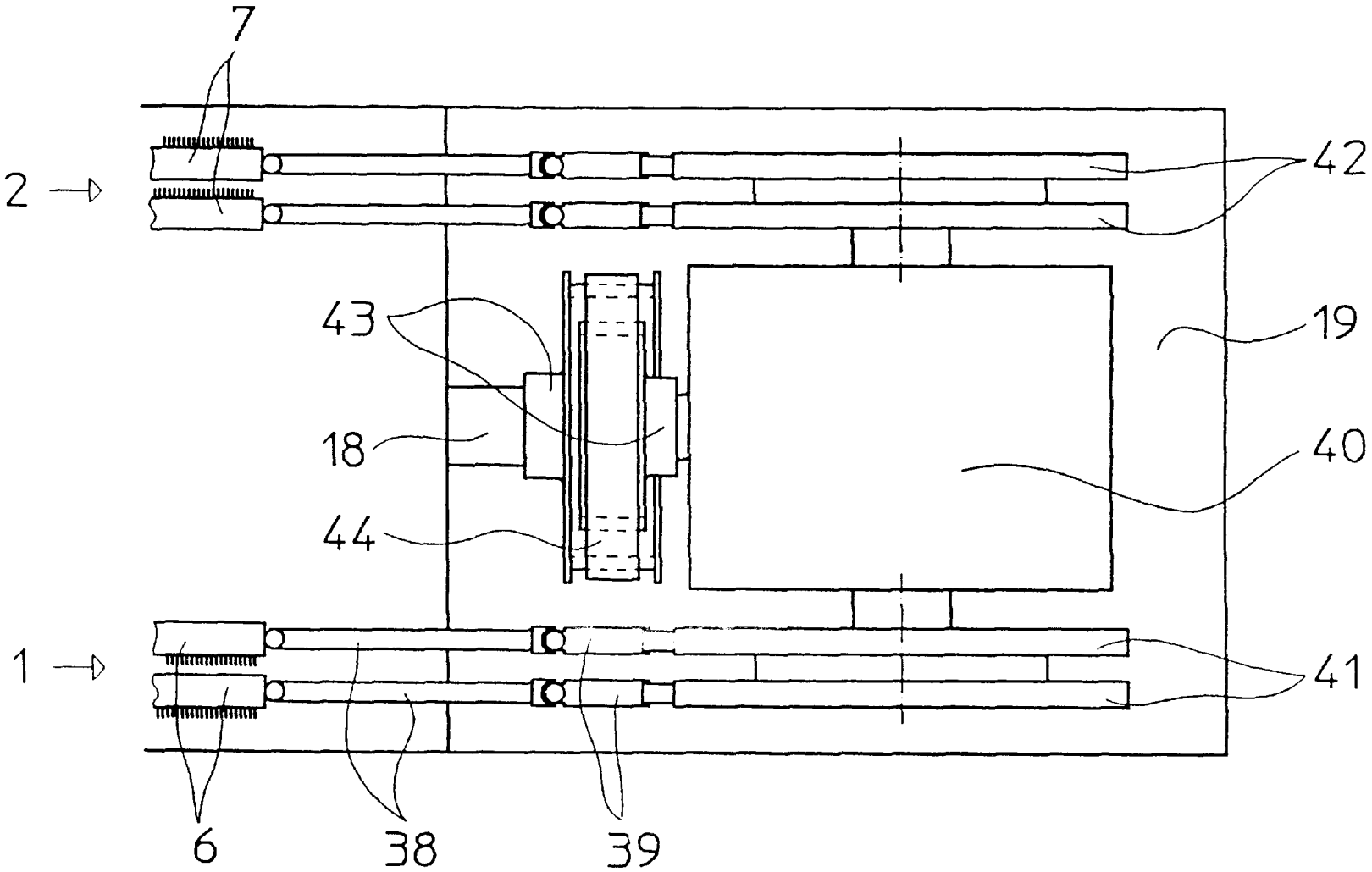
FIG. 5 is a schematic top view of an arrangement of a shifting drive for the inventive device.

FIG. 5 is a schematic top view of a basic arrangement of a shifting device, respectively, a pattern device for the inventive device. Thereby, the pattern controlled shifting of the guide bars 6, 7 of the knitting areas 1, 2, according to the invention, are driven by only one common shaft 18 by way of a corresponding transmission device 42, 43 into a common shifting, respectively, pattern device from which the respective pattern discs 41, 42 for the corresponding guide bars 6, 7 for the knitting areas 1, 2 are driven. From the main shaft 18, its movement is transferred into the pattern drive by way of the transfer system 43, 44, which in this embodiment consists of cleated belt discs 43 and cleated belts 44. The essential advantage, according to the inventive device, when only one shaft 18 is contemplated, yields the fact that in this case only one shifting drive has to be provided. As is well known, a shifting drive 40 is provided on a console which is rigidly connected with the machine frame 19. From this shifting drive 40, the corresponding work movements are emanating and are directed toward the corresponding guide bars of each of the knitting areas 1, 2. Dictated by the drive of the pattern discs 41, 42, the pattern contained therein is transferred to the guide bars 6 as well as 7 by way of slide pushers 39 and push rods 38.

Basically, the use of one common pattern drive 40, even when using two shafts and one main shaft 18 in a device according to the invention, is possible when no additional coupling has been provided between the shafts and the knitting elements.

One of the embodiments of the device of the invention contains two shafts and a main shaft 18 and couplings 28, 29 between the shafts and the knitting elements or between the main shaft and the shafts. By this arrangements the advantage of a coupling can be realized because each of the knitting areas 1 as well as 2 can be shut down and therefore, in such a case, a special shifting drive has been assigned to each of the guide bar groups so that when shutting down one knitting area a continued operation of the other knitting area would not be possible.

| Reference Character List | |
|---|---|
| 1, 2 | Knitting areas |
| 3 | Threads |

-continued

| Reference Character List | |
|---|---|
| 4, 5 | Fabric webs |
| 6, 7 | Guide bars |
| 8, 9 | Knitting needles |
| 10, 11 | Pusher bars |
| 12, 13 | Knitting needle bars |
| 14, 15 | Plate bar |
| 16, 17 | Weft insertion systems |
| 18 | Main shaft |
| 19 | Machine frame |
| 20 | Warp beam frame |
| 21 | Warp beam |
| 22 | Material wind-up rollers |
| 23 | Material pull-down rollers |
| 24 | Coupling members |
| 25 | Coupling drives |
| 26 | Drive for main shaft |
| 28, 29 | Couplings |
| 30 | LENA-Compound drives |
| 31 | Shaft for the guide bars |
| 32 | Shaft for the needle bars |
| 33 | Crank for the LENA-drive |
| 34 | PLASHI-compound drive |
| 35 | Lever element for the closure bar |
| 36 | Shaft for the closure bar |
| 37 | Shaft for the plate bar |
| 38 | push rods |
| 39 | Slide pushers |
| 40 | Shifting/Pattern drive |
| 41, 42 | Pattern discs |
| 43 | Toothed belt drive discs |
| 44 | Toothed belt |
| 45 | Crank for PLASHI |
| 46 | Lever element for plate bar. |

We claim:

1. A warp knitting machine for the production of warp knitted fabrics having at least two independent knitting areas (1, 2) wherein each of said knitting areas includes at least one needle bar (12, 13) and at least one guide bar (6, 7) and wherein each of said knitting areas produces a fabric web and wherein said knitting areas are arranged back-to-back so that the directions of respective web pull-off are directed outwardly away from said knitting areas and wherein said needle bars (12, 13) and said guide bars (6, 7) of both knitting areas are supported in a common machine frame, wherein the improvement comprises the common machine frame (19) having a common main shaft (18) which drives both knitting areas (1, 2) over compound drives (30).

2. A warp knitting machine according to claim 1, wherein the knitting areas (1,2) are provided each with a group of warp beams (21) and a material pull-off (23,22).

3. A warp knitting machine according to claim 2, wherein each group of warp beams is located on each side of a plane of symmetry extending through the knitting areas.

4. A warp knitting machine according to claim 1, further comprising a mechanism for shifting the guide bars (6, 7) of each of said knitting areas (1, 2) and means for controlling said mechanisms from a common shifting drive.

5. A warp knitting machine according to claim 1, wherein the at least one needle bar (12, 13) and the at least one guide bar (6,7) of each of said knitting areas produces a fabric web different from each other.

6. A warp knitting machine according to claim 5, wherein one knitting area includes two bars while the other knitting area includes three bars.

7. A warp knitting machine according to claim 1, further comprising a weft insertion system (16, 17) which is arranged between the knitting areas (1, 2).

8. A warp knitting machine for the production of warp knitted fabrics having at least two independent knitting areas (1, 2) wherein each of said knitting areas includes at least one needle bar (12, 13) and at least one guide bar (6, 7) wherein each of said knitting areas produces a fabric web and wherein said knitting areas are arranged back-to-back so that the directions of respective web pull-off are directed outwardly away from said knitting areas and wherein said needle bars (12, 13) and said guide bars (6, 7) of both knitting areas are supported in a common machine frame, wherein the improvement comprises the common machine frame (19) having a common main shaft (18) which drives both knitting areas (1, 2) over compound drives (30), wherein the knitting areas (1, 2) are provided each with a group of warp beams (21) and a material pull-off (23, 22), wherein two warp beams (21) of a group of warp beams (21) are each driven by a common warp beam drive.

* * * * *